US006598743B1

(12) United States Patent
Puskaric

(10) Patent No.: US 6,598,743 B1
(45) Date of Patent: Jul. 29, 2003

(54) GOLF CLUB ORGANIZER

(76) Inventor: Joseph Anthony Puskaric, 63 Soling Crescent, Mt. Pleasant, New South Wales (AU), 2749

( * ) Notice: Subject to any disclaimer, the term of this patent is extended or adjusted under 35 U.S.C. 154(b) by 0 days.

(21) Appl. No.: 10/133,146

(22) Filed: Apr. 26, 2002

Related U.S. Application Data

(63) Continuation of application No. PCT/AU00/01325, filed on Oct. 27, 2000.

(51) Int. Cl.[7] ..... A63B 55/00; A63B 57/00

(52) U.S. Cl. ..... 206/315.6; 206/315.3; 211/70.2

(58) Field of Search ..... 206/315.3, 315.6; 211/70.2

(56) References Cited

U.S. PATENT DOCUMENTS

| | | | | | |
|---|---|---|---|---|---|
| 1,849,610 | A | * | 3/1932 | Boyce | 206/315.6 |
| 3,331,419 | A | * | 7/1967 | Bencriscutto | 206/315.6 |
| 3,503,518 | A | * | 3/1970 | Black | 206/315.6 |
| 4,194,547 | A | * | 3/1980 | Sidor et al. | 206/315.6 |
| 4,208,227 | A | * | 6/1980 | Cowan | 206/315.6 |
| 5,228,566 | A | * | 7/1993 | Shenoha | 206/315.6 |
| 5,465,840 | A | | 11/1995 | Joh | |
| 5,620,091 | A | | 4/1997 | Larson | |
| 5,816,397 | A | | 10/1998 | Pratt | |
| 5,918,737 | A | * | 7/1999 | Kwon | 206/315.3 |
| 5,964,346 | A | | 10/1999 | O'Connor | |
| 6,138,825 | A | * | 10/2000 | Summerlin | 206/315.6 |
| 6,158,581 | A | * | 12/2000 | Hong | 206/315.3 |

FOREIGN PATENT DOCUMENTS

| | | | |
|---|---|---|---|
| WO | 9928005 | * | 6/1999 |

* cited by examiner

*Primary Examiner*—Sue A. Weaver
(74) *Attorney, Agent, or Firm*—Pearne & Gordon LLP

(57) ABSTRACT

A club organizer for a golf club carry bag, comprising a cover means adapted to fit across the opening of the golf club carry bag, the cover means having an arcuately shaped ridge member adapted to be supported along a portion of a rim defining the opening of the carry bag, the ridge member having a convex outer side wall and a concave inner side wall defining a concavity, and web means located within the concavity for rigidizing the ridge member by urging the ridge member against the rim, the ridge member being so inclined as to have an upper and a lower end and including a plurality of descending apertures for passing the shaft of each of the iron clubs therethrough and into the carry bag, each of the apertures including a groove formed through the outer side wall for locating the head of respective ones of the iron clubs so that, in accordance with the inclination of the ridge member, each of the apertures is at a different height to each other of the apertures whereby the head of each of the iron clubs are vertically spaced apart from each other and are directed away from the concavity, and the web means defining a plurality of apertures for locating the head of each of the wood clubs.

2 Claims, 7 Drawing Sheets

GOLF CLUB ORGANIZER

This application is a continuation of PCT/AU00/01325, filed Oct. 27, 2000, and published in English on May 3, 2001.

FIELD OF INVENTION

The present invention relates to an improved apparatus for supporting golf clubs and, in particular, to a club holder or club organizer for a golf carry bag.

BACKGROUND ART

It is an important element of the game of golf that the clubs (including the putter) be stably supported and readily accessible to the golfer at all times during play. Numerous apparatus for this purpose have been marketed over the years under such trade marks as "CADDY RACK", "CLUB RACK" and "CLUB MATE". Each of these apparatus have enjoyed widespread use as a general type of club holder, but they are less suitable for the more specialized needs of the professional golfer who requires the orderly, as well as stable, holding of up to 14 clubs in a golf bag for the purpose of easy access and retrieval.

A common problem with some prior art club holding apparatus is that the club shafts are not aligned and spaced apart in parallel fashion, but rather they are criss-crossed and abutting which may, over time and with improper handling, cause structural damage to the clubs. Furthermore, the desired club may be difficult to extract from a bag in which the clubs are criss-crossed and abut each other.

Another problem with many prior art golf club holding apparatus is that they do not allow for easy access to the club head for quick extraction of the desired club from the bag. In such apparatus, the club heads, because of their close and often abutting physical proximity, are prone to suffer collision and subsequent damage during carrying of the bag or in the process of extraction of a club therefrom.

This problem has been overcome in Australian Petty Patent No. 691,464 to the present inventor by the provision of a golf club holding apparatus comprising a cover adapted to fit across the opening of a gold bag. The cover has two or more ridges which are separately inclined from the horizontal so that each aperture thereof is at a different height. In this way, all of the club heads located in the apertures are vertically spaced apart from each other so as to enable the golfer or caddy to readily access and easily extract the appropriate club from the golf bag.

Whilst the apparatus of Australian Petty Patent No. 691, 464 has met with success, a need has developed for a golf club organizer with a lower profile than that which results from having two or more separately inclined ridges, such as in the club holder of Australian Petty Patent No. 691,464, but without sacrificing the feature of having the apertures for locating the head of each of the nine iron clubs, which are the most tangle prone of the 14 clubs, positioned on an inclined ridge. The desired low profile of the organizer and inclined positioning of the heads of the iron clubs must be coupled with an efficient and aesthetically pleasing layout of the organizer to suit golfers' tastes.

Furthermore, the organizer should provide a generally even weight distribution of the clubs when the bag is being carried or supported on a stand.

SUMMARY OF THE INVENTION

Accordingly, the present invention provides a club organizer for a golf club carry bag, comprising a cover means adapted to fit across the opening of the golf club carry bag, the cover means having an arcuately shaped ridge member adapted to be supported along a portion of a rim defining the opening of the carry bag, the ridge member having a convex outer side wall and a concave inner side wall defining a concavity, and web means located within the concavity for rigidizing the ridge member by urging the ridge member against the rim, the ridge member being so inclined as to have an upper and a lower end and including a plurality of descending apertures for passing the shaft of each of the iron clubs therethrough and into the carry bag, each of the apertures including a groove formed through the outer side wall for locating the head of respective ones of the iron clubs so that, in accordance with the inclination of the ridge member, each of the apertures is at a different height to each other of the apertures whereby the head of each of the iron clubs are vertically spaced apart from each other and are directed away from the concavity, and the web means defining a plurality of apertures for locating the head of each of the wood clubs.

Preferably, the organizer includes a collar means supported along the rim and upon which is supported the cover means, the collar means including reinforcing members for supporting partitioning means which are located between the shafts of at least some of the iron clubs, the partitioning means extending downwardly from the collar means.

BRIEF DESCRIPTION OF THE DRAWINGS

In order that the present invention may be readily understood and put into practical effect, reference will now be made to the accompanying drawings, in which.

DETAILED DESCRIPTION OF THE INVENTION

Figure 1:
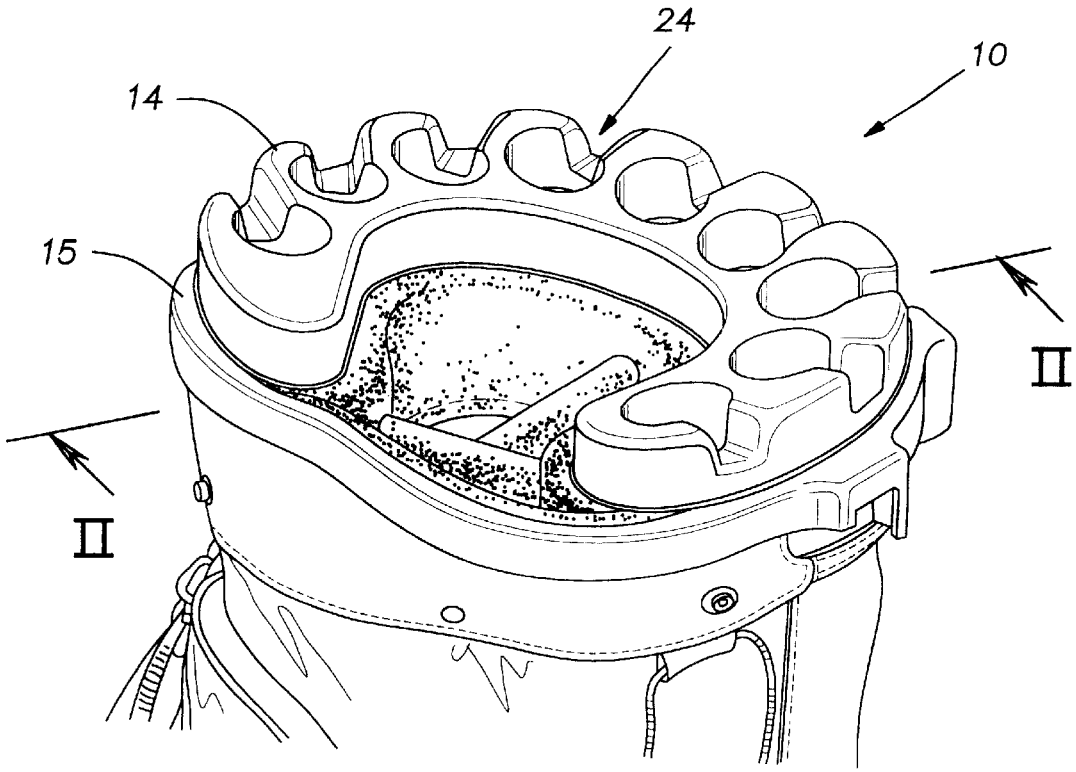
FIG. 1 is a perspective view of a golf club organizer according to a first preferred embodiment of the present invention, fitted to the opening of a golf club carry bag.
Figure 2:
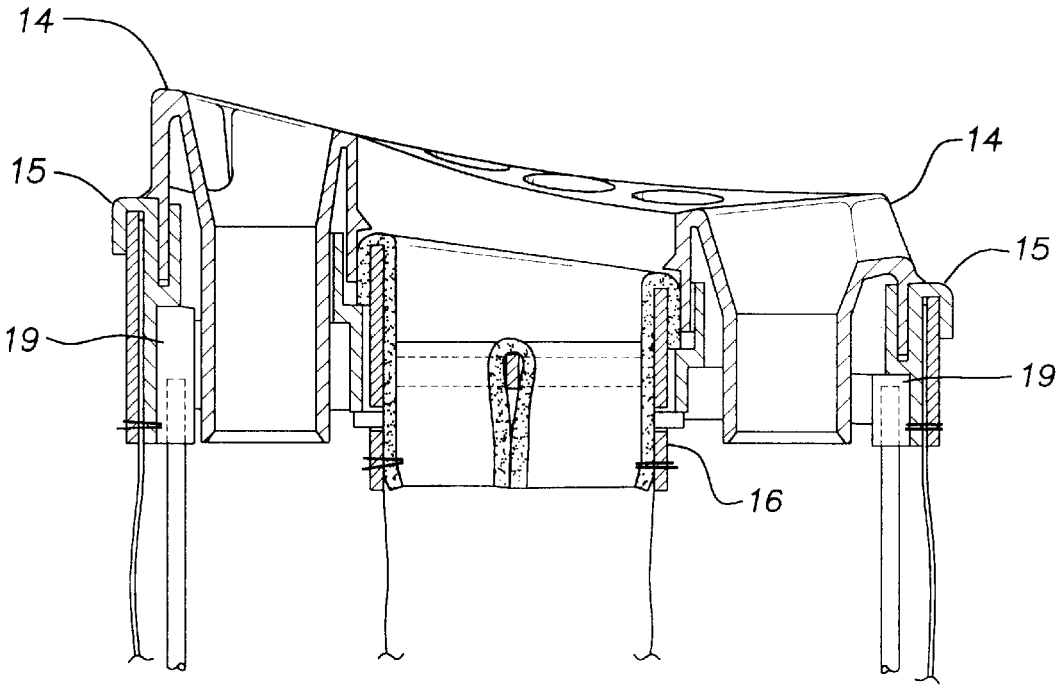
FIG. 2 is sectional side view through II—II of the golf club organizer of FIG. 1.
Figure 3:
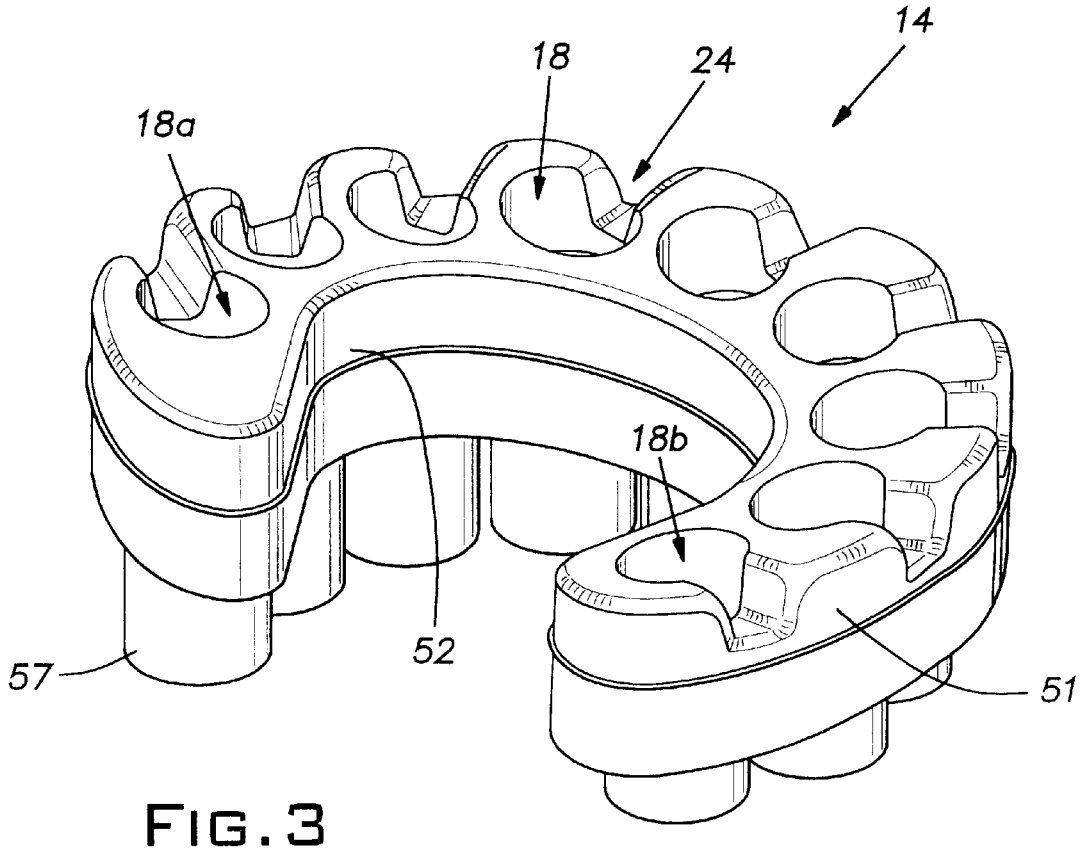
FIG. 3 is a perspective view of the ridge member of the golf club organizer of FIG. 1.
Figure 4:
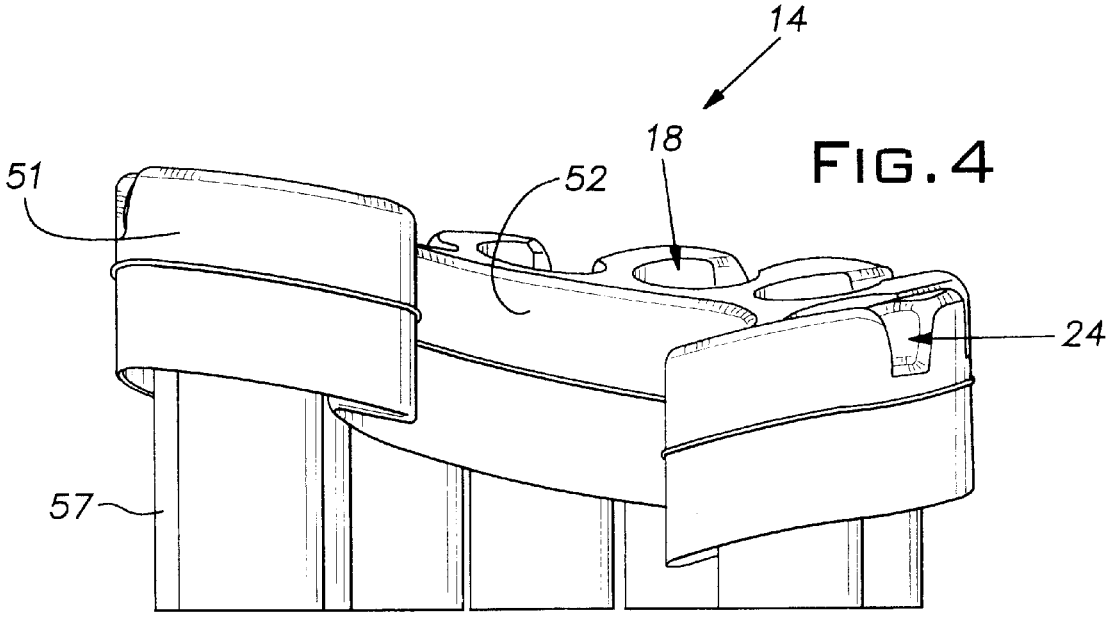
FIG. 4 is a front elevational view of the ridge member of FIG. 3.
Figure 5:
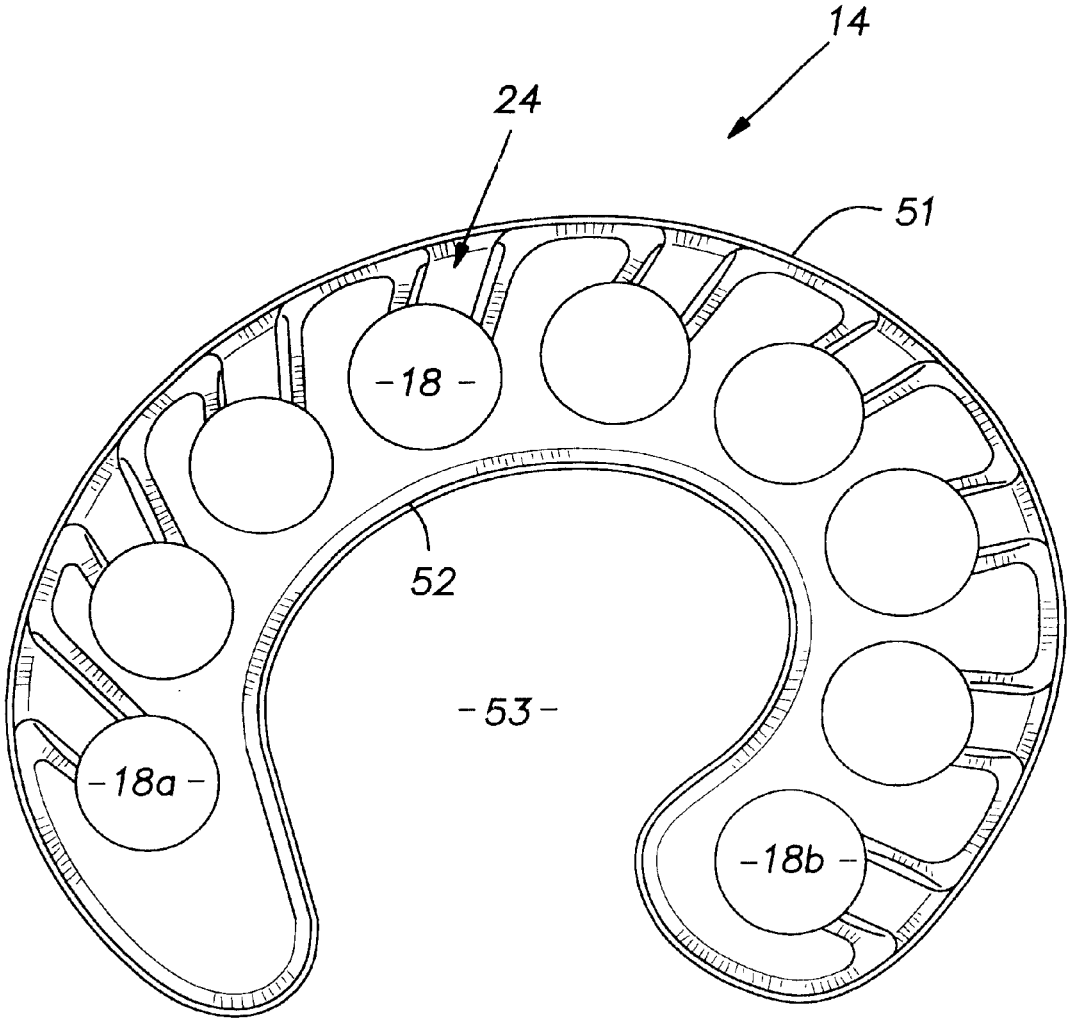
FIG. 5 is a top elevational view of the ridge member of FIG. 3.

The golf club organizer 10 shown in the Figures is suited for bags carried by a strap over the shoulder of a person (see particularly FIG. 10), and can be manufactured to have an upper weight limit well within the acceptable range of weights for carry bags, say, with the use of a suitably light weight thermoplastic rubber (such as that manufactured under KRAIBURG from Germany).

The organizer 10 comprises, in this embodiment, a cover 12 which fits across the opening or mouth of the carry bag. The cover 12 has an arcuately shaped ridge member 14 made of a thermoplastic rubber, and a detachable web piece 16 made of polypropylene for maintaining rigid the arcuate shape of the ridge member 14.

The ridge member 14 and web piece 16 are supported on a collar 15, made of polypropylene, which is itself supported on the metal or hardened rim defining the mouth of the carry bag.

The ridge member 14 has a convex outer side wall 51 and a concave inner side wall 52. The inner side wall 52 defines a space or concavity 53. The web piece 16 is located in the concavity 53 and urges the ridge member 14 against the rim 19.

The ridge member 14 has nine apertures 18 for locating in each a single one of the nine iron clubs conventionally used in the playing of golf. The ridge member 14 is inclined to the horizontal in such a way as to present a spiral fall from an uppermost aperture 18*a* at the upper end of the ridge member 14 to a lowermost aperture 18*b* at the lower end, each of the apertures thus being at a different height to each other of the apertures. In this way, the heads of each of the iron clubs are vertically spaced apart from each other.

The web piece 16 has reinforcing members 17 that define therebetween three apertures for locating the head of each of the wood clubs and a putter. One of these apertures may locate more than one club head if required.

The ridge member 14 allows the heads of the iron clubs to be located in individual apertures which protect the heads of the wood clubs from damage, such as chipping, caused by inadvertent collision between the irons and woods. At each aperture for the iron clubs, there is a groove 24 or trough formed through the outer side wall 51 and upon which the head rests and which points the head in a direction away from the concavity 53. The grooves 24 are contoured specially to provide smooth, rounded surfaces against which the head abuts. The lowest point of each groove 24, if interconnected by a line (imaginary), follows a spiral or inclined path around the ridge member 14, in accordance with the inclination of the ridge member 14 itself. The grooves 24 are also formed so as to suit both left and right handed clubs.

Figure 7:
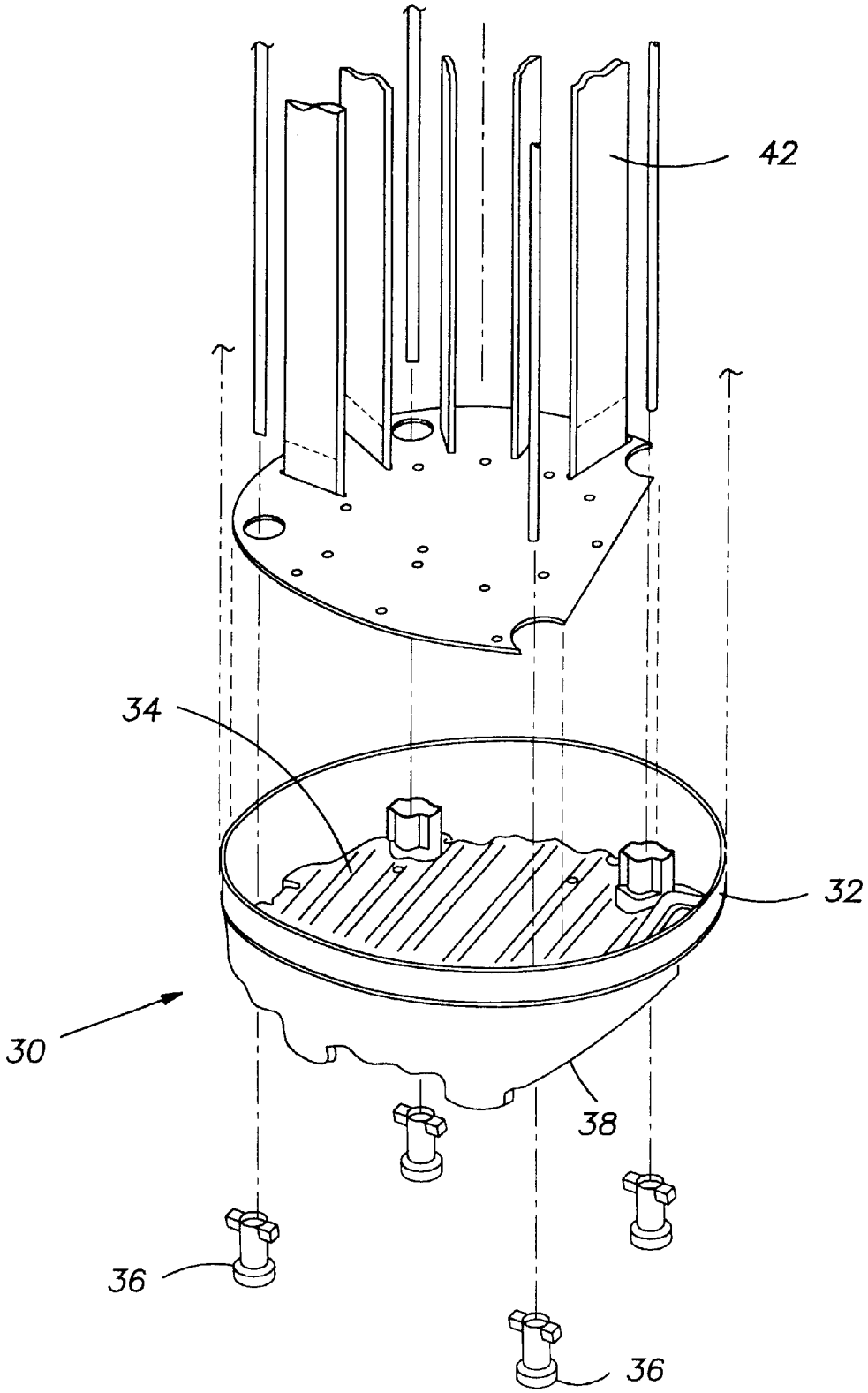
FIG. 7 is an exploded perspective view of the partitioning means shown in FIG. 6, together with an exploded view of a base for the carry bag partly shown in FIG. 1, the base including a removable anchor plate to which the partitioning means are attached.

The base 30 shown in FIG. 7 is for a carry bag which can be used with the organizer 10. The base 30 has a skirt portion 32, a corrugated floor 34, stand feet 36 descending from the floor 34, and a sloping base region 38. The sloping base region 38 is conventionally used in co-operation with built on or attachable carry bag stands to allow the carry bag to stand at an angle to the horizontal determined by the slope of the region 38.

Figure 6:
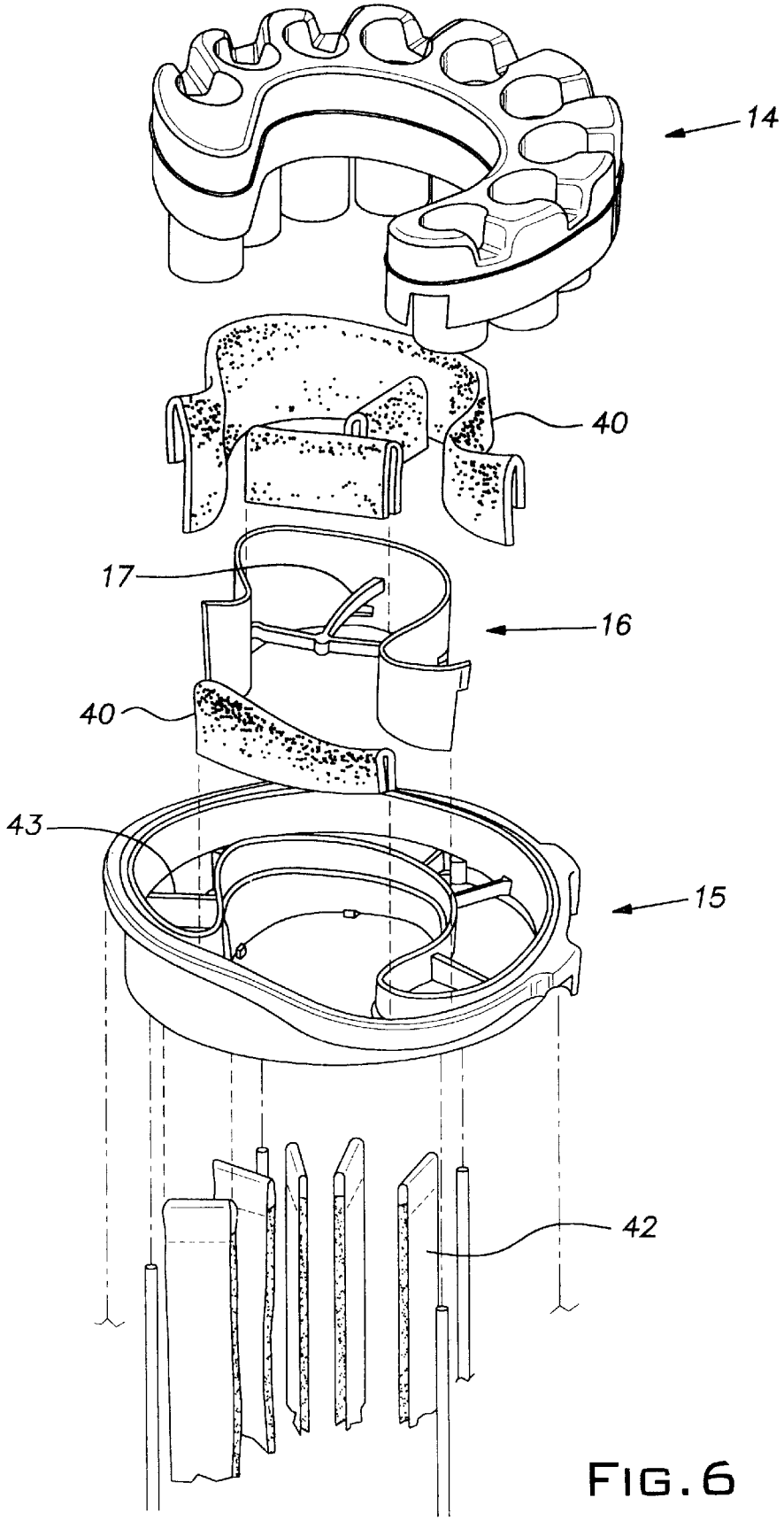
FIG. 6 is an exploded perspective view of the golf club organizer shown in FIG. 1, together with partitioning means for location between the shafts of some of the iron clubs.

The arrangement shown in FIG. 6 comprises, in this embodiment, the ridge member 14, folded and contoured cushioning material 40 for overlying both the web piece 16 and the exposed part of the collar 15, the web piece 16, the collar 15, and partitioning means 42 adapted to be positioned between adjacent shafts of most of the iron clubs to be supported by the organizer 10. The partitioning means 42, in the interest of weight reduction, are made of sheets of 220 density nylon, and extend downwardly from some of the ribs 43 in the collar 15 to fixed anchor locations on the base 30, (see FIG. 7) so assisting to prevent the shafts from tangling with each other during movement of the carry bag. Partitioning means of this kind may also be positioned between the shafts of the wood clubs, in which case the partitioning means would extend downwardly from the reinforcing members 17 of the web piece 16 to the base 30. The partitioning means 42 may also be in the form of polyethylene or other plastic tubes, provided that the overall weight of the carry bag remains within the acceptable range. Such tubes 57, which also assist in the partitioning of iron club shafts, are shown in the Figures.

Figure 8:
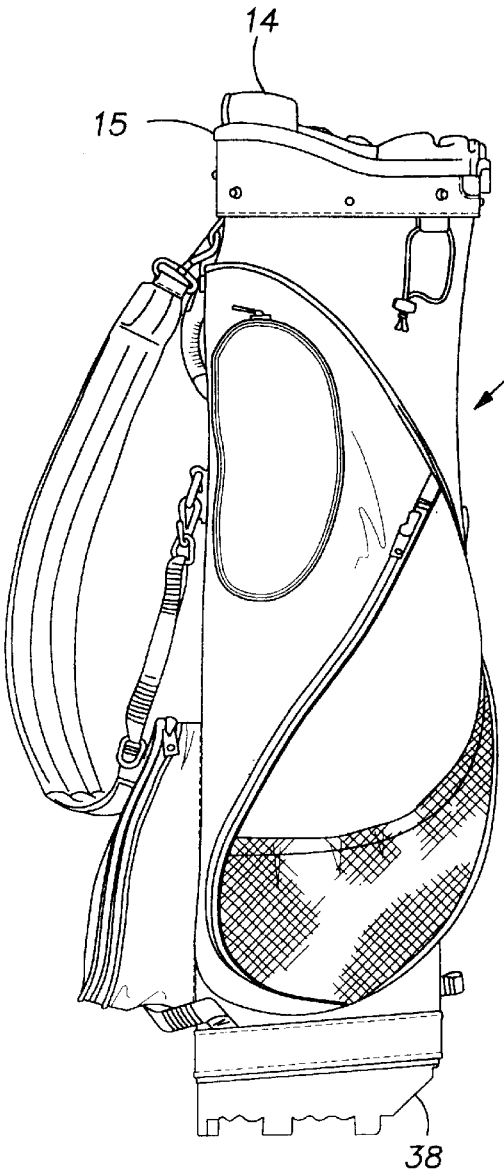
FIG. 8 is a left side elevational view of a golf club carry bag with the golf club organizer of FIG. 1 fitted thereto.
Figure 9:
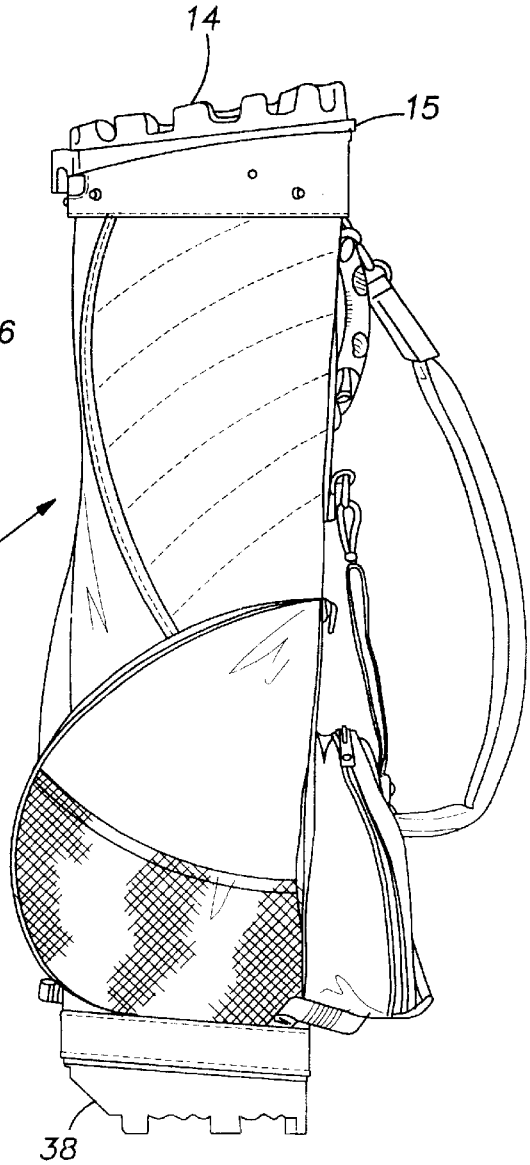
FIG. 9 is a right side elevational view of a golf club carry bag with the golf club organizer of FIG. 1 fitted thereto.

The carry bag 46 shown in FIGS. 8 and 9 has been assembled with the golf club organizer 10. The ridge member 14 is shown with the grooves 24 following a spiral fall around the arcuate structure.

Figure 10:
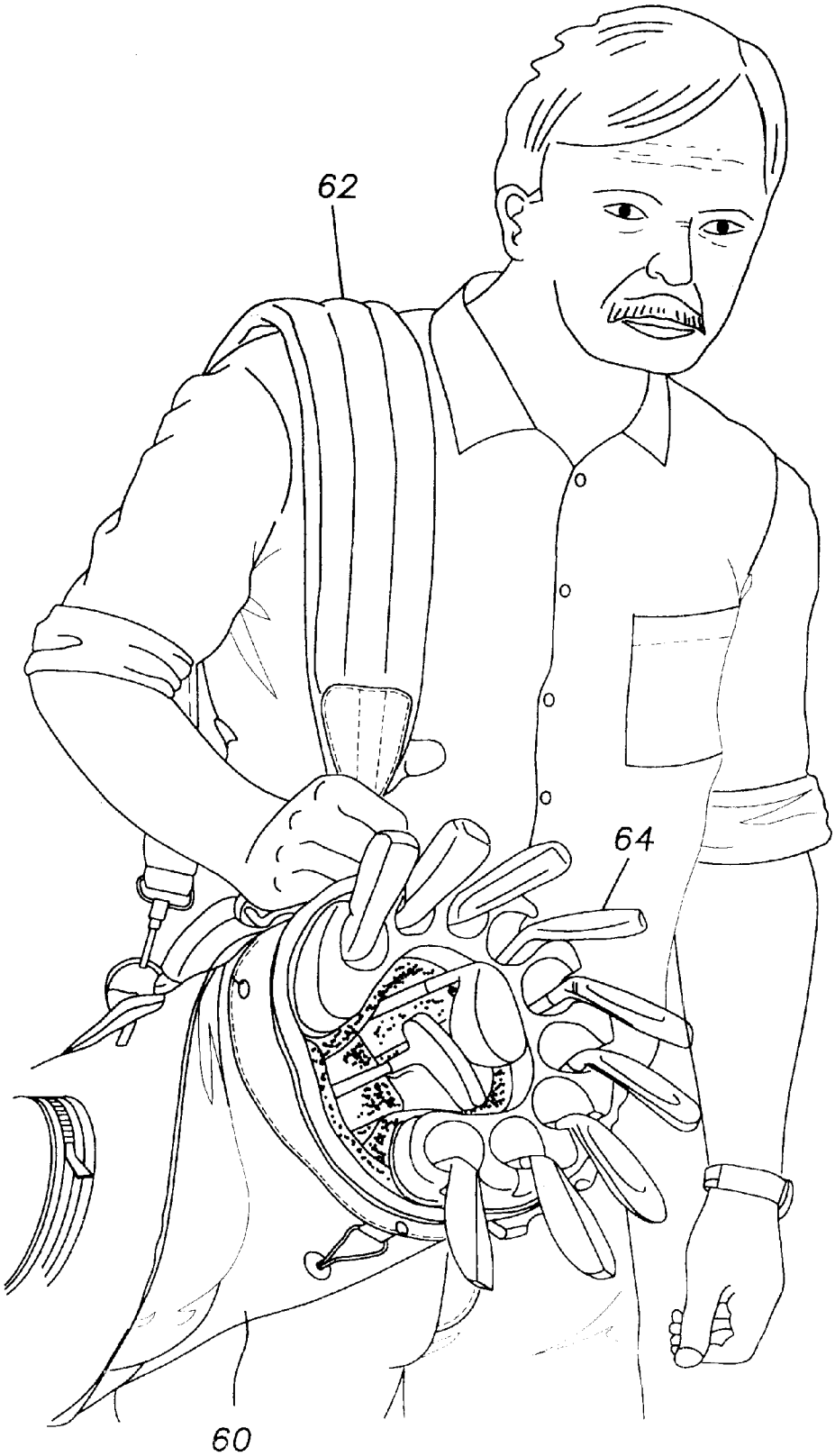
FIG. 10 is an isometric view of a golfer carrying the carry bag of FIGS. 8 and 9 with clubs supported therein.

It is an advantage of the golf club organizer 10 that, when fitted to a carry bag 60 that is being carried by a strap 62 over the shoulder of a person, the iron club shafts 64 will not deviate from their positions within the apertures 18, and their heads will remain directed away from the concavity and, thus, away from the wood club heads and putter, as shown in FIG. 10. This arrangement prevents tangling and rattling of the iron club shafts during carrying.

The generally peripheral and spaced apart positioning of the heavier iron clubs around the top or perimeter of the carry bag, as provided by the organizer 10, ensures an even weight distribution of clubs around the organizer and bag, providing an added benefit during carrying.

Although the organizer 10 may utilize partitioning nylon sheets to keep separate the shafts of the irons, such partitioning sheets are not as necessary to keep separate the shafts of those irons located downwardmost whilst being carried, as those shafts will rest stabily upon the material of the bag itself.

Various modifications may be made in details of design and construction without departing from the scope and ambit of the invention.

What is claimed is:

1. A club organizer for a golf club carry bag, comprising a cover means adapted to fit across the opening of the golf club carry bag, the cover means having an arcuately shaped ridge member adapted to be supported along a portion of a rim defining the opening of the carry bag, the ridge member having a convex outer side wall and a concave inner side wall defining a concavity, and web means located within the concavity for rigidizing the ridge member by urging the ridge member against the rim, the ridge member being so inclined as to have an upper and a lower end and including a plurality of descending apertures for passing the shaft of each of the iron clubs therethrough and into the carry bag, each of the apertures including a groove formed through the outer side wall for locating the head of respective ones of the iron clubs so that, in accordance with the inclination of the ridge member, each of the apertures is at a different height to each other of the apertures whereby the head of each of the iron clubs are vertically spaced apart from each other and are directed away from the concavity, and the web means defining a plurality of apertures for locating the head of each of the wood clubs.

2. The club organizer for the golf club carry bag of claim 1 wherein the organizer includes a collar means supported along the rim and upon which is supported the cover means, the collar means including reinforcing members for supporting partitioning means which are located between the shafts of at least some of the iron clubs, the partitioning means extending downwardly from the collar means.

* * * * *